US012372014B2

(12) United States Patent
Císar et al.

(10) Patent No.: US 12,372,014 B2
(45) Date of Patent: Jul. 29, 2025

(54) ROCKER ARM ASSEMBLY COMPRISING SWING BRIDGE

(71) Applicant: Eaton Intelligent Power Limited, Dublin (IE)

(72) Inventors: Ondrej Císar, Dvur Kralove nad Labem (CZ); Ondrej Bolehovský, Prague (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/951,385

(22) Filed: Nov. 18, 2024

(65) Prior Publication Data

US 2025/0137391 A1 May 1, 2025

Related U.S. Application Data

(63) Continuation of application No. 18/364,259, filed on Aug. 2, 2023, now Pat. No. 12,152,512.

(60) Provisional application No. 63/387,025, filed on Dec. 12, 2022, provisional application No. 63/394,999, filed on Aug. 4, 2022.

(51) Int. Cl.

| | |
|---|---|
| ***F01L 1/26*** | (2006.01) |
| ***F01L 1/18*** | (2006.01) |
| ***F01L 1/46*** | (2006.01) |
| ***F01L 13/06*** | (2006.01) |
| *F01L 1/24* | (2006.01) |

(52) U.S. Cl.

CPC ..... *F01L 1/26* (2013.01); *F01L 1/181* (2013.01); *F01L 1/267* (2013.01); *F01L 1/46* (2013.01); *F01L 13/06* (2013.01); *F01L 13/065* (2013.01); *F01L 2001/186* (2013.01); *F01L 1/2411* (2013.01)

(58) Field of Classification Search

CPC ..... F01L 1/181; F01L 1/2411; F01L 1/267; F01L 1/46; F01L 13/06; F01L 13/065

USPC ..... 123/90.4, 90.44, 90.46

See application file for complete search history.

(56) References Cited

U.S. PATENT DOCUMENTS

| | | | | |
|---|---|---|---|---|
| 2018/0003088 | A1* | 1/2018 | Nielsen | F01L 1/181 |
| 2020/0182098 | A1* | 6/2020 | McCarthy, Jr. | F01L 1/24 |
| 2021/0324769 | A1* | 10/2021 | Gron, Jr. | F01L 1/146 |
| 2023/0016116 | A1* | 1/2023 | Lahr | F01L 13/06 |

FOREIGN PATENT DOCUMENTS

| | | | | |
|---|---|---|---|---|
| WO | WO-2023025565 | A1 * | 3/2023 | F01L 1/181 |

* cited by examiner

*Primary Examiner* — Jorge L Leon, Jr.
(74) *Attorney, Agent, or Firm* — Baker Botts L.L.P.

(57) ABSTRACT

A rocker arm assembly comprises a first rocker arm having a first valve end, a second rocker arm having a second valve end, a first valve, a second valve, a hydraulic capsule disposed in the first valve end and movable between an extended and retracted position, and a swing bridge selectively actuatable by the first or second rocker arm and span the first and second valve. In engine brake mode, the hydraulic capsule moves to the extended position, causing the swing bridge to swing angularly as the first rocker arm rotates so as to actuate the first valve without actuating the second valve. In drive mode, the hydraulic capsule moves to the retracted position, and the swing bridge is actuated by the second valve end of the second rocker arm as the second rocker arm rotates so as to actuate both the first valve and the second valve.

20 Claims, 12 Drawing Sheets

ROCKER ARM ASSEMBLY COMPRISING SWING BRIDGE

PRIORITY

This application is a continuation under 35 U.S.C. § 120 of U.S. patent application Ser. No. 18/364,259, filed 2 Aug. 2023, which claims the benefit under 35 U.S.C. § 119(e) of U.S. Provisional Patent Application No. 63/394,999, filed 4 Aug. 2022, and U.S. Provisional Patent Application No. 63/387,025, filed 12 Dec. 2022, each of which is incorporated by reference herein in its entirety.

TECHNICAL FIELD

This disclosure generally relates to a valvetrain system, and more particularly to a rocker arm assembly comprising a swing bridge.

BACKGROUND

Various valve system designs have been produced in the past for use in connection with internal combustion engines for the purpose of controlling valve actuation such as for main exhaust event. Generally, in a typical valvetrain, a rocker arm system is coupled on one side to a camshaft and on the other side to a number of engine valves via a valve bridge in a way for delivering actuation motion from the camshaft to downstream valves in synchronization. In some scenarios, it may be desirable to provide auxiliary functionality, such as compression engine braking, in addition to the main lift event such that a chosen valve may be separately controlled. To achieve this, a switchable system is often employed, which can be selectively translated between a retracted and extended position, the retracted position disabling actuation of the associated valve by a corresponding dedicated rocker arm and the extended position enabling actuation of the valve. Correspondingly, the valve bridge may also be equipped with a motion-transmitting mechanism that serves to independently actuate the selected valve without affecting the others. However, current designs typically utilize a sliding component that moves up and down within the valve bridge, which introduces force balancing issues and occupies relatively large packaging space.

Consequently, there is a need to provide a solution that not only demands less space but also offers improved system dynamics.

SUMMARY OF PARTICULAR EMBODIMENTS

This disclosure presents a rocker arm assembly having a swing bridge that is able to swing on demand to actuate at least one selected valve separately from a totality of valves in order to achieve auxiliary valve function. By employing a swing mechanism that may transfer motion from a rocker arm to an associated valve and at the same time move relative to the swing bridge, the system disclosed herein may achieve better force and/or motion transmission, reduce undesired wear in various valvetrain components, and improve dynamic behavior of the overall assembly. Moreover, the embodiments according to this disclosure may offer packaging advantages and are less demanding in terms of spatial requirement.

In one embodiment, a rocker arm assembly operable in a drive mode and an engine brake mode is provided. The rocker arm assembly comprises a first rocker arm having a first valve end, a second rocker arm having a second valve end, a first valve, a second valve, a hydraulic capsule disposed in the first valve end and movable between an extended position and a retracted position, and a swing bridge configured to be selectively actuated by the first rocker arm or the second rocker arm and span the first valve and the second valve. In particular, in the engine brake mode, the hydraulic capsule moves to the extended position, causing the swing bridge to swing angularly as the first rocker arm rotates so as to actuate the first valve without actuating the second valve. Whereas in the drive mode, the hydraulic capsule moves to the retracted position, and the swing bridge is actuated by the second valve end of the second rocker arm as the second rocker arm rotates so as to actuate both the first valve and the second valve.

In particular embodiments, the rocker arm assembly further comprises a first cam for actuating the first rocker arm and a second cam for actuating the second rocker arm.

In particular embodiments, in the engine brake mode, the second rocker arm is deactivated or is on base circle of the second cam.

In particular embodiments, in the drive mode, the first rocker arm is deactivated or is on base circle of the first cam.

In particular embodiments, the swing bridge comprises a swing mechanism that is vertically aligned with the hydraulic capsule.

In particular embodiments, a center of the swing bridge is vertically aligned with the second valve end.

In particular embodiments, in the drive mode, when the swing bridge is actuated by the second rocker arm, a horizontal axis of the swing bridge remains perpendicular to axes of the first and second valves.

In particular embodiments, in the engine brake mode, when the swing bridge swings angularly upon actuation by the hydraulic capsule, the swing bridge tilts about a tip of the second valve.

In particular embodiments, a vertical axis of the swing mechanism is parallel to an axis of the first valve throughout operation.

In particular embodiments, the hydraulic capsule comprises a plunger configured to be hydraulicly controlled to move between an extended position to allow contact with the swing bridge and a retracted position to avoid contact with the swing bridge.

In one embodiment, a rocker arm assembly comprises a first rocker arm having a first valve end, a second rocker arm having a second valve end, a first valve, a second valve, a hydraulic capsule disposed in the first valve end and movable between an extended position and a retracted position, and a swing bridge configured to be selectively actuated by the first rocker arm or the second rocker arm and span the first valve and the second valve. Specifically, the swing bridge comprises a bridge body including a through opening and a bore intersecting the through opening, and a swing mechanism configured to connect between the hydraulic capsule and the first valve. The swing mechanism comprises a swing pin configured to swing in the through opening and a rotary cylinder configured to support the swing pin and rotate in the bore. Moreover, the swing bridge is further configured to swing angularly upon actuation by the hydraulic capsule so as to actuate the first valve without actuating the second valve, and actuate both the first valve and the second valve upon actuation by the second rocker arm.

In particular embodiments, in the retracted position of the hydraulic capsule, the hydraulic capsule does not engage the swing mechanism during rotation of the first rocker arm. Moreover, in the extended position of the hydraulic capsule, at least a portion of the hydraulic capsule extends outwards from the first valve end and is able to engage the swing mechanism during rotation of the first rocker arm.

In particular embodiments, the swing mechanism further comprises a first contact area for contacting the hydraulic capsule, and the bridge body comprises a second contact area for contacting the second valve end.

In particular embodiments, the swing mechanism is located at one side of the swing bridge and is vertically aligned with the hydraulic capsule.

In particular embodiments, the second contact area is located near a center of the swing bridge and is vertically aligned with the second valve end.

In particular embodiments, the through opening is arranged along a vertical direction.

In particular embodiments, the bore is arranged perpendicular to the through opening.

In particular embodiments, the rotary cylinder is secured axially by the swing pin.

In particular embodiments, a major axis of the rotary cylinder is perpendicular to a major axis of the swing pin.

In particular embodiments, a clearance is defined between the swing pin and the through opening so as to allow swinging of the swing pin inside the through opening.

BRIEF DESCRIPTION OF THE DRAWINGS

Embodiments in accordance with this disclosure will now be described by reference to the accompanying drawings, in which.

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up", "down", "right", and "left" are for ease of reference to the figures and not intended to limit the scope of this disclosure.

Figure 1:
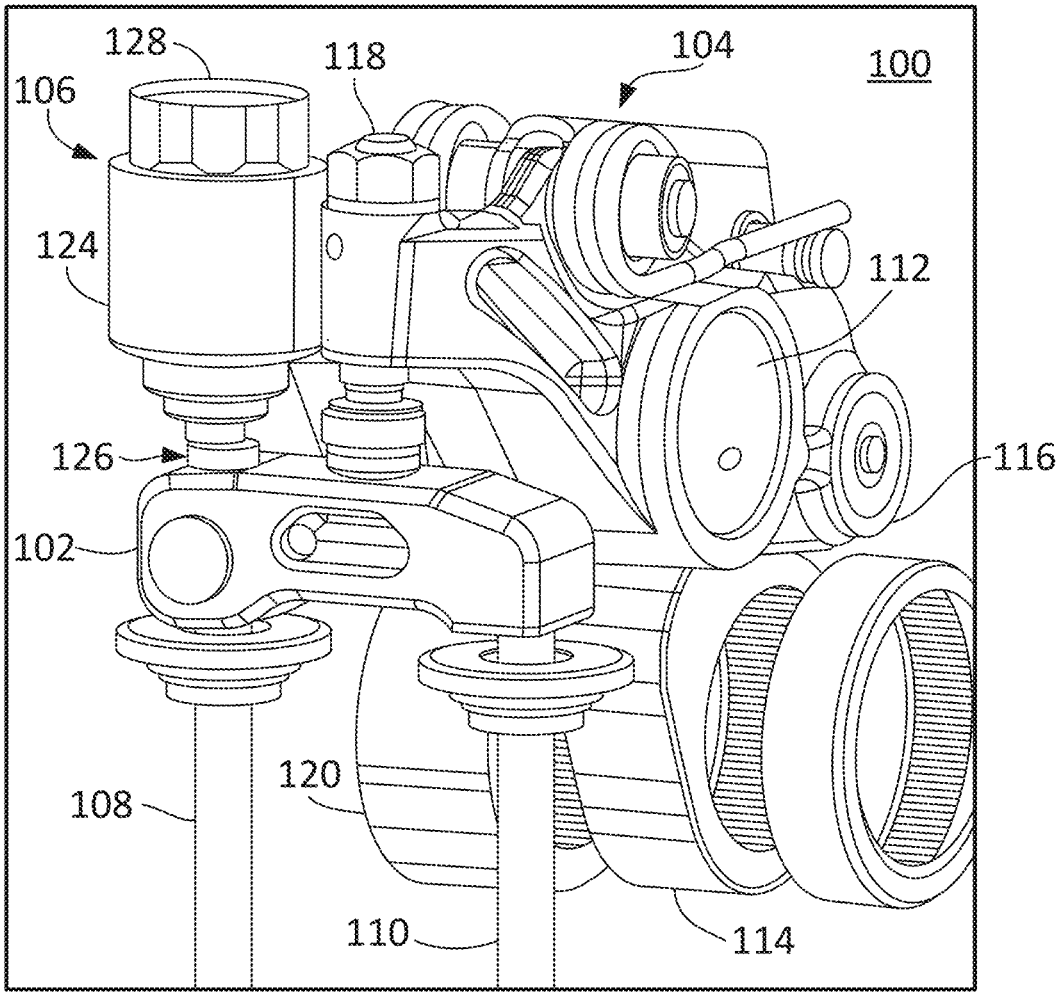
FIG. 1 illustrates a rocker arm assembly that incorporates a swing bridge according to this disclosure.
Figure 2:
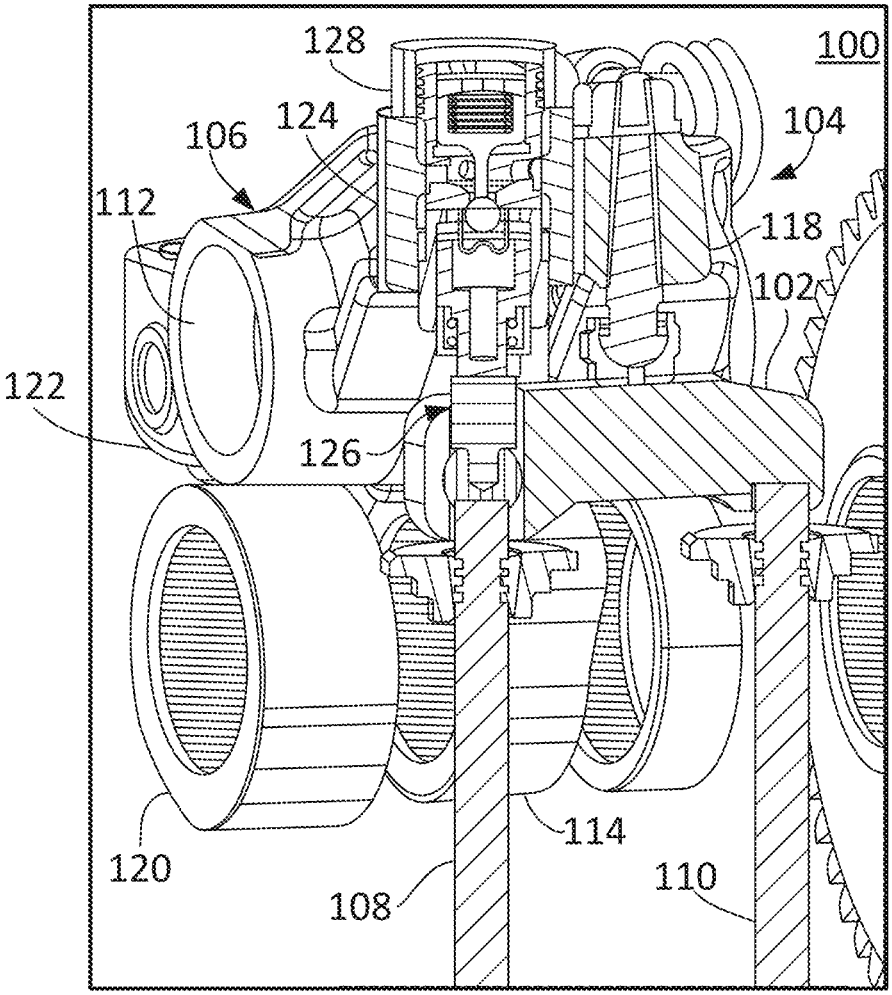
FIG. 2 illustrates a partial cross-sectional view of the rocker arm assembly of FIG. 1.

FIGS. 1-2 show an example rocker arm assembly 100 having a swing bridge 102 in accordance with one embodiment of this disclosure. In the embodiment as shown, the rocker arm assembly 100 may generally include a main rocker arm 104 such as a main exhaust rocker arm and a secondary or auxiliary rocker arm 106 such as an engine brake rocker arm. The main rocker arm 104 and the secondary rocker arm 106 may cooperate (e.g., under a control strategy or method) so as to selectively actuate a first engine valve 108 and a second engine valve 110 by means of the swing bridge 102 which connects between the rocker arms 104, 106 and the engine valves 108, 110. More specifically, for example, the first engine valve 108 may be actuated separately from the second engine valve 110 such that the first engine valve 108 may operate on a lift profile associated with the secondary rocker arm 106 while the second engine valve 110 may operate on another lift profile associated with the main rocker arm 104, details of which will become appreciated from the following discussion.

While particular embodiments of this disclosure may be set forth in the context of rocker arms for operating exhaust valves in an engine braking system, for example, such as for use in 1.5 or 2 stroke compression braking, it will nevertheless be appreciated by one of skill in the art that the disclosure is not limited to such an application. Various embodiments in accordance with this disclosure may be equally or similarly applicable to other types of systems in the valvetrain assembly. For example, embodiments of this disclosure may be used in connection with an intake rocker arm system, an extended valve closing system, an early valve opening system, or other suitable valvetrain systems as familiar to a skilled person in the art.

With continued reference to FIGS. 1-2, in particular embodiments, the main rocker arm 104 may be pivotably supported by a rocker shaft (not shown) extending through a central opening 112 such that the main rocker arm 104 may rotate around the rocker shaft based on a cam lift profile of a main lift cam 114. Specifically, a cam end 116 of the main rocker arm 104 may contact or otherwise be coupled to the main lift cam 114 for receiving valve actuation motion. A valve end 118 opposite to the cam end 116 may in turn be configured to engage the swing bridge 102 as the main rocker arm 104 rotates so as to transfer motion from the main lift cam 114 to both of the engine valves 108 and 110 coupled to the swing bridge 102. Similarly, in particular embodiments, the secondary rocker arm 106, which for example may be arranged in parallel to the main rocker arm 104, may also be supported by the cam shaft in a rotatable manner. As shown, the secondary rocker arm 106 may include a cam end 122 that serves to receive valve actuation motion from a secondary lift cam 120 (for example, an engine brake lift cam) and a valve end 124 opposite to the cam end 122 and configured to selectively engage a swing mechanism 126 of the swing bridge 102 on demand. In particular embodiments, the swing mechanism 126 may be configured to convey actuation motion from the secondary rocker arm 106 to the one engine valve—e.g., the first engine valve 108 associated with engine braking—while allowing the swing bridge 102 to swing a certain angular degree in a manner to avoid actuation of the other engine valve, e.g., the second engine valve 110. Details of the swing mechanism 126 and the swing bridge 102 will be more fully described below with reference to FIGS. 4-6.

In particular embodiments, it may be desirable to configure the secondary rocker arm 106 to be selectively switchable such that one can choose whether the secondary lift cam 120 can actuate the associated engine valve 108 or not. That is, the secondary rocker arm 106 may transfer between a main mode (i.e., the valve end 124 is spaced from contact relative to the swing bridge 102, thus the associated engine valve 108 remains unactuated regardless of rotation of the secondary rocker arm 106) and an auxiliary mode (i.e., the valve end 124 engages the swing bridge 102 via the swing mechanism 126 as the secondary rocker arm 106 reciprocates, allowing motion to be delivered to the engine valve 108.) To this end, a hydraulic capsule 128 may be provided at the valve end 124 of the secondary rocker arm 106. The hydraulic capsule 128 may be controlled hydraulicly by pressurized fluid supplied via a fluid circuit running through the secondary rocker arm 106 and configured to move between a retracted position and an extended position. In particular embodiments, for example, the hydraulic capsule 128 may be received by a vertical bore arranged in the valve end 124 of the secondary rocker arm 106. During operation, the hydraulic capsule 128 may be actuated on demand to either protrude outwards from the bottom of the valve end 124 to contact the swing mechanism 126 or retract back into the valve end 124 to avoid touching the swing mechanism 126.

Figure 3:
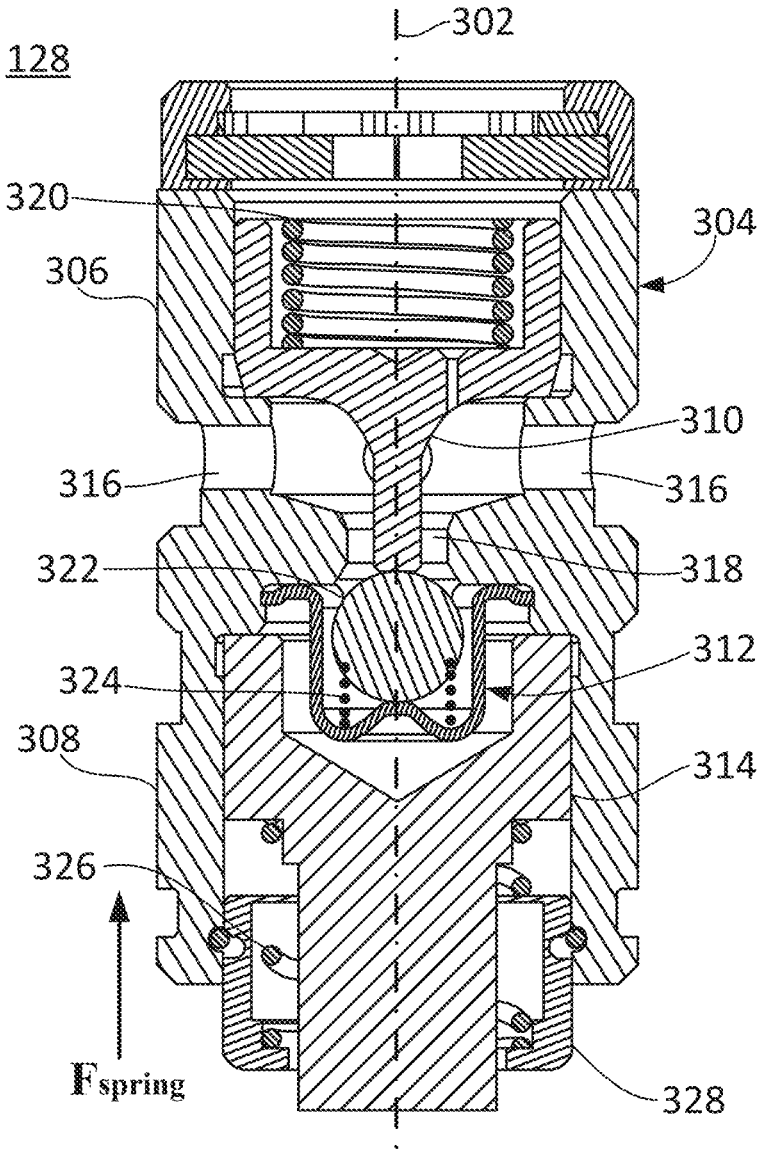
FIG. 3 illustrates a cross-sectional view of a hydraulic capsule according to this disclosure.

FIG. 3 illustrates a standalone cross-sectional view of the hydraulic capsule 128 in greater details, particularly showing the hydraulic capsule 128 in its retracted state. In particular embodiments, the hydraulic capsule 128 may comprise a housing 304, which is generally cylindrical in shape and may include an upper chamber 306 and a lower chamber 308. In the example as shown, the upper chamber 306 and the lower chamber 308 may together form a single body that defines the housing 304 for housing and/or containing various components of the hydraulic capsule 128 in an in-line manner. For example, the upper chamber 306 may house a pin 310 while the lower chamber 308 may house a check valve assembly 312 and a plunger 314, each being aligned along a capsule axis 302.

As shown in FIG. 3, the upper chamber 306 may be ported with one or more fluid channels 316, which, for example, may be arranged circumferentially on a side wall of the upper chamber 306 and configured to receive hydraulic fluid (e.g., oil) supplied via the secondary rocker arm 106. The lower chamber 308 may be positioned below the upper chamber 306 and is configured to be in fluid communication with the upper chamber 306 via an opening 318 disposed between the upper chamber 306 and the lower chamber 308. In this way, pressurized fluid introduced through the fluid channel 316 into the upper chamber 306 may be allowed to enter via the opening 318 to the lower chamber 308—for example, in a selective way under the control of the check valve assembly 312, details of which will be more clearly explained below.

As further illustrated in FIG. 3, the upper chamber 306 may contain the pin 310. The pin 310 may be hydraulicly controlled by fluid pressure introduced in the upper chamber 306 to compress and/or extend vertically along the capsule axis 302. As an example, in the configuration as depicted, a spring 320 may be coupled to a top end of the pin 310 and configured to bias down the pin 310 to its extended position. As fluid flows in and hydraulic pressure builds up inside the upper chamber 306, the hydraulic force may overcome the downward biasing force applied by the spring 320, consequently pushing the pin 310 in an upward direction into retraction. In particular embodiments, the check valve assembly 312 located downstream of the pin 310 may be configured to selectively enable fluid communication between the upper chamber 306 and the lower chamber 308 based on the movement of the pin 310. The check valve assembly 312 may be arranged in the lower chamber 308 in a position that is directly below the opening 318. In the embodiment as shown, the check valve assembly 312 comprises a check ball 322, which may be pressed down by the pin 310 in order to open fluid passage through the opening 318. During operation, the check ball 322 may normally seat against the opening 318, e.g., by means of a valve spring 324 urging the check ball 322 upwards. In this manner, when biased, the check ball 322 may become a one-way valve that allows fluid to flow downwards to the lower chamber 308 but prevents it from flowing back in the opposite direction to the upper chamber 306. When the pin 310 moves to its extended position, a lower terminal end of the pin 310 may protrude into the opening 318 and push against the check ball 322, thereby unseating the check ball 322 from the opening 318 and allowing fluid to flow past the check ball 322 into the lower chamber 308, or vice versa.

With continued reference to FIG. 3, the lower chamber 308 may further house the plunger 314. For example, the plunger 314 may be disposed below and in line with the check valve assembly 312. In particular embodiments, the plunger 314 is configured to translate a certain distance inside the lower chamber 308 (for example, vertically along the capsule axis 302) between an extended position and a retracted position upon actuation by the fluid introduced into the lower chamber 308. For example, when the lower chamber 308 is filled with the pressurized fluid, the plunger 314 may be hydraulicly actuated in a downward direction to such a position where a lower end of the plunger 314 extends out from the bottom of the hydraulic capsule 128. In doing so, as the secondary rocker arm 106 rotates, the plunger 314 may make contact with the swing bridge 102, thus enabling motion transmission to the downstream engine valve 108. In particular embodiments, a spring 326 may be coupled to the plunger 314, e.g., near a lower end of the plunger 314. For example, a spring seat 328 may be provided to support the spring 326 upwards, which is attached or fixed into an end portion of the lower chamber 308. As indicated by an arrow in FIG. 3, the spring 326 may provide an upward spring force to the plunger 314 such that when fluid pressure is removed, the plunger 314 may return into retraction. In this retracted configuration, substantial or entire portion of the plunger 314 may generally be contained within the lower chamber 308 in a manner to refrain from contacting the swing bridge 102 even when the secondary rocker arm 106 rotates, thus deactivating the engine valve 108 as needed. In other words, by configuring the hydraulic capsule 128 in this manner, a variable volume may be formed, which expands when pressurized fluid reaches the lower chamber 308 through the check valve assembly 312 and pushes the plunger 314 downwards, and shrinks when the check valve assembly 312 opens to release fluid out of the lower chamber 308, thereby switching the hydraulic capsule 128 between the extended state and the retracted state.

The design of the hydraulic capsule 128 disclosed herein contrasts those of prior art since the plunger 314 can remain compressed as default by means of the spring 326 when deactivation is needed, thus avoiding any contact between the hydraulic capsule 128 and the swing bridge 102. This can save the system from undesired wearing, reduce the risk of damage to the movable components, and help maintaining proper system dynamics.

Although depicted and described in this particular manner, a person of skill in the art will appreciate that the rocker arm assembly disclosed herein is provided for illustration purposes only, and not intended to limit the scope of this disclosure. Other suitable configurations are also envisioned by this disclosure. For example, certain embodiments in accordance with this disclosure may comprise only some, if not all, of the above-described structures without departing from the scope of this disclosure. Alternatively, other additional features as familiar in the art may be optionally provided and will not be described in exhaustive detail herein.

Figure 4:
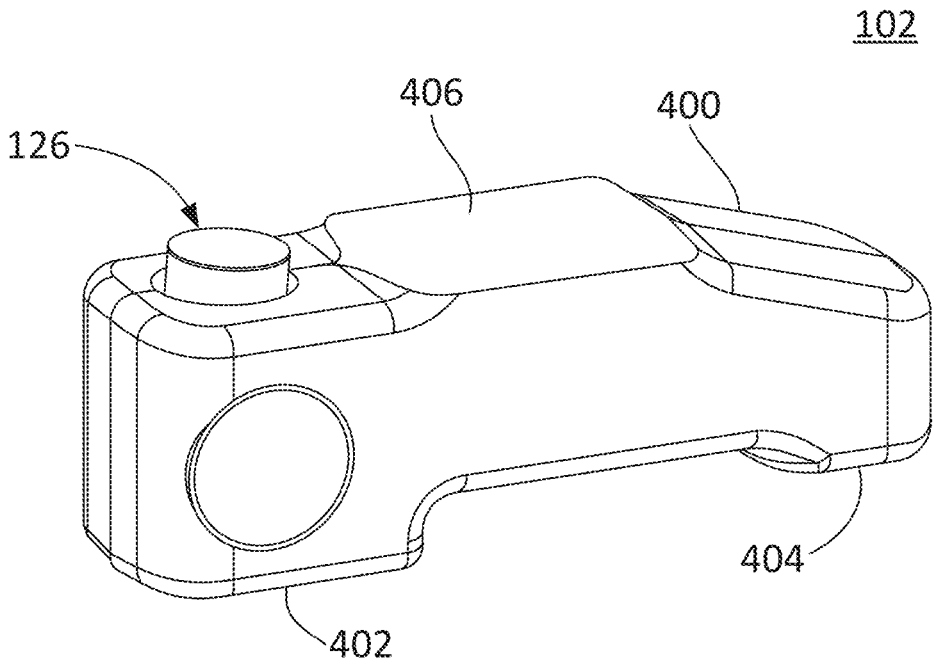
FIG. 4 illustrates a standalone view of the swing bridge of FIG. 1.
Figure 5:
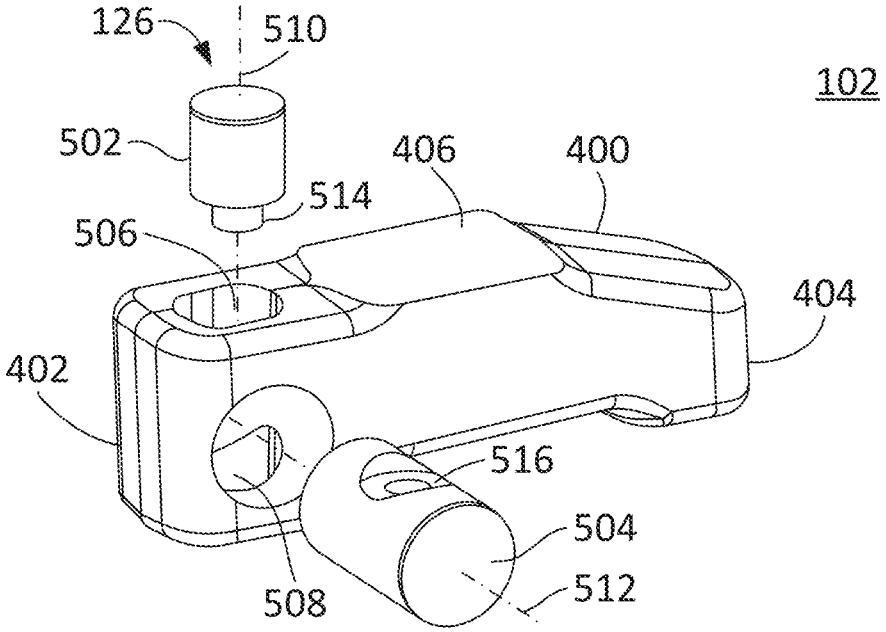
FIGS. 5-6 illustrate two exploded views of the swing bridge taken from different perspectives.
Figure 6:
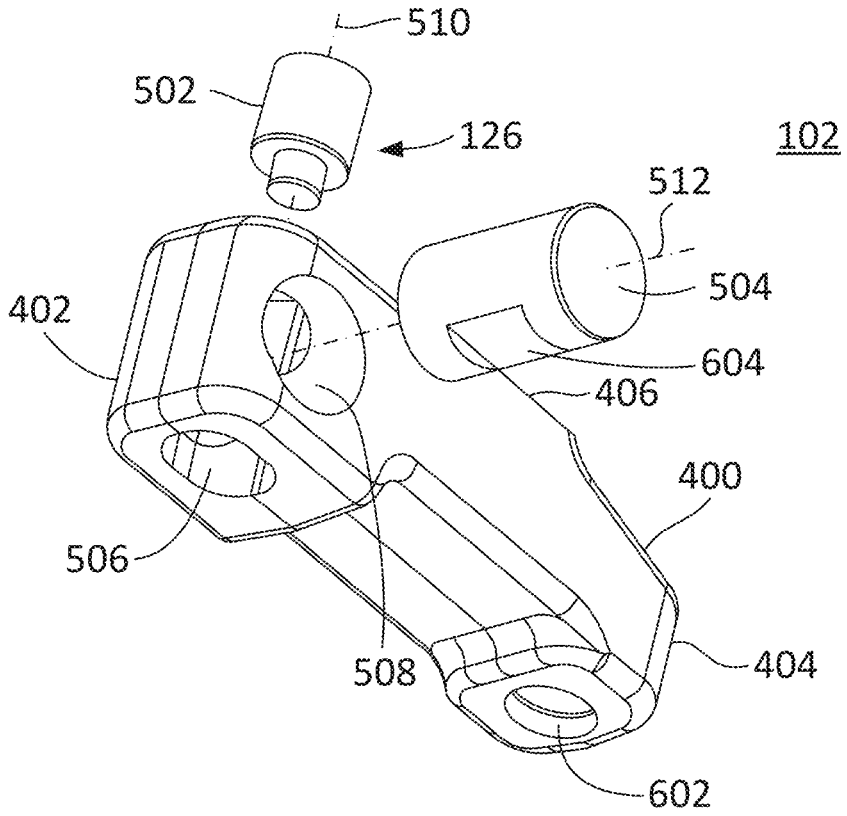

FIG. 4 shows an isometric view of the swing bridge 102 that has the swing mechanism 126 according to this disclosure, and FIGS. 5-6 show various exploded views of the swing bridge 102 taken from different perspectives. In particular embodiments, the swing bridge 102 may be configured to span and sit atop the engine valves 108 and 110. As an example and not by way of limitation, in the embodiment as depicted, a main body 400 of the swing bridge 102 may include a first valve side 402 that may be operatively coupled to the terminal end of the engine valve 108, and a second valve side 404 that is generally opposite to the engine brake valve side 402 and may be operatively coupled to the terminal end of the engine valve 110. For example, in some embodiments, the second valve side 404 may be provided at a bottom portion thereof with a valve seat 602, which may rest on top of and receive the tip of the engine valve 110. While depicted as a circular recess, the valve seat 602 may take form in a different shape, such as oval, elongated, rounded, or other suitable shapes as familiar to those skilled in the art. Furthermore, top surface of the main body 400 may be provided with a contact area 406, which may be located near the center of the main body 400 in a position that is vertically aligned with the valve end 118 of the main rocker arm 104. During operation, the contact area 406 may engage the valve end 118 as the main rocker arm 104 presses down so as to transfer motion downstream (i.e., in the direction of force transmission), thereby actuate both of the engine valves 108 and 110. For example, the contact area 406 may be substantially flat to better maintain contact and ensure proper motion and/or force delivery. Of course, other suitable surface structures such as curved or concave surface area are also contemplated by this disclosure for performing the desired motion-conveying function.

With continued reference to FIGS. 4-6, in particular embodiments, the swing mechanism 126 may be disposed at the first valve side 402 so as to engage or contact the engine valve 108 that for example is associated with engine braking. The swing mechanism 126 may in general include a swing pin 502 and a rotary cylinder 504 that supports the swing pin 502 (e.g., vertically upwards as shown in the figures). As an example and not by way of limitation, in the embodiment as shown, a major axis 510 of the swing pin 502 may be arranged perpendicular to a major axis 512 of the rotary cylinder 504. In order to accommodate the swing pin 502 and rotary cylinder 504, respectively, the first valve side 402 may correspondingly be structured with a through opening 506 which, for example, may extend along the vertical direction inside the main body 400 and a bore 508 that may horizontally intersect the through opening 506. Specifically, in particular embodiments, the length of the rotary cylinder 504 (e.g., measured along the major axis 512) may substantially be equal to the length of the bore 508 such that when inserted, the rotary cylinder 504 may interface with at least a portion of the main body 400. Provided as such, during assembly of the illustrated embodiment, the rotary cylinder 504 may first be fitted into the bore 508 such that its major axis 512 is aligned with the center axis of the bore 508. The swing pin 502 may thereafter be inserted into the through opening 506 so as to sit against and engage the rotary cylinder 504.

As further illustrated, in this example embodiment, the swing pin 502 may generally be cylindrical in structure. Nevertheless, other suitable configurations (such as elongated or the like) are also contemplated for performing the desired functions of this disclosure. In particular embodiments, the swing pin 502 may include at upper end thereof a contact surface for contacting the hydraulic capsule 128 so as to receive actuation motion therefrom. Furthermore, the swing pin 502 may also include an insert 514 (e.g., in the form of a protrusion) extending from a lower end thereof in order to engage with the rotary cylinder 504. Accordingly, upper surface of the rotary cylinder 504 may be provided with a recess or slot 516 that is shaped to mate with the insert 514 and/or the lower end of the swing pin 502 in such a way that the insert 514 and/or the lower end may be snugly fitted into the slot 516 so as to axially secure the rotary cylinder 504. Additionally or alternatively, other suitable connecting or mating structures or methods such as snap fit, interference fit, or the like may be employed for properly securing the swing pin 502 and the rotary cylinder 504 together. Configured in this way, the rotary cylinder 504 may be able to maintain secure engagement with the swing pin 502 at the same time providing support to the swing pin 502.

In the embodiment as shown, lower surface of the rotary cylinder 504 may be configured with a valve seat 604, which may maintain contact with the terminal of the engine valve 108 throughout system operation. As an example and not by way of limitation, the valve seat 604 may include a substantially flat area that rests on top of the valve tip in order to ensure proper contact with the engine valve 108, thereby transmitting actuation movement to the engine valve 108 as needed. Alternatively or additionally, while not shown, optional retention features such as clips or the like may be provided at the valve seat 604 to provide for additional degree of securement. Of course, other suitable surface structures such as curved surface area as familiar to those skilled in the art are also envisioned by this disclosure for performing the intended function of engaging the engine valve.

Figure 7:
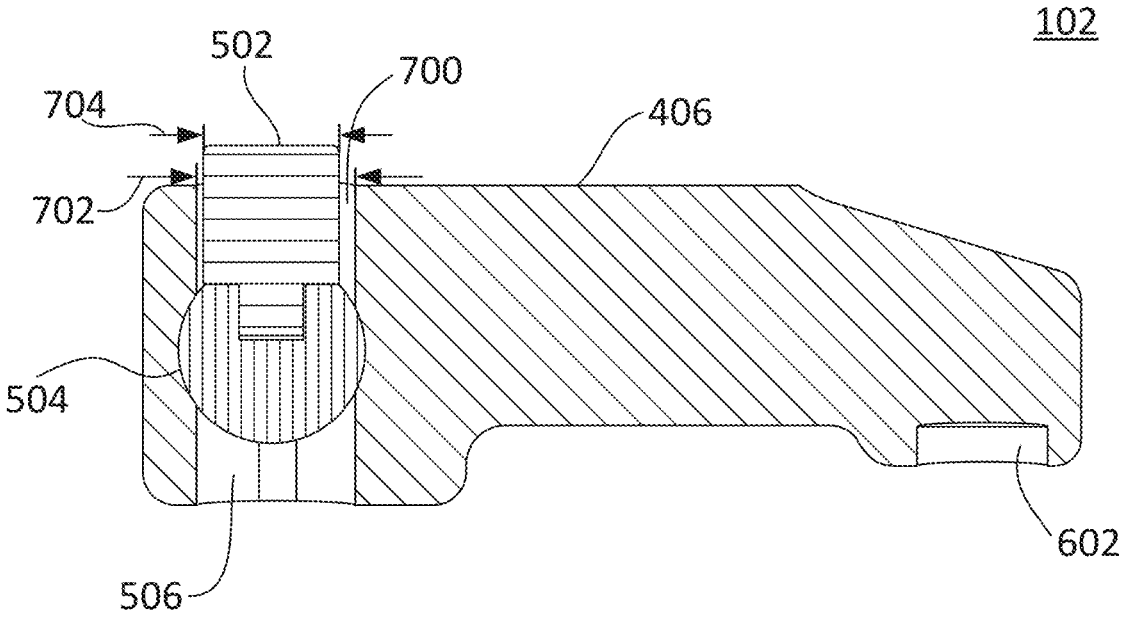
FIG. 7 illustrates a schematic cross section of the swing bridge.

FIG. 7 schematically depicts a cross section of the swing bridge 102 taken along a longitudinal axis. As can be clearly observed in this illustration, a clearance 700 may be defined between the swing pin 502 and the through opening 506, e.g., specifically between the outer wall of the swing pin 502 and the interior side of the through opening 506. In other words, the through opening 506 may be dimensioned with a width 702 that is relatively larger that the outer diameter or width 704 of the swing pin 502. In this way, spatial redundancy may be permitted for containing the swing pin 502 in a manner to accommodate swinging of the swing pin 502 inside the through opening 506.

Figure 8:
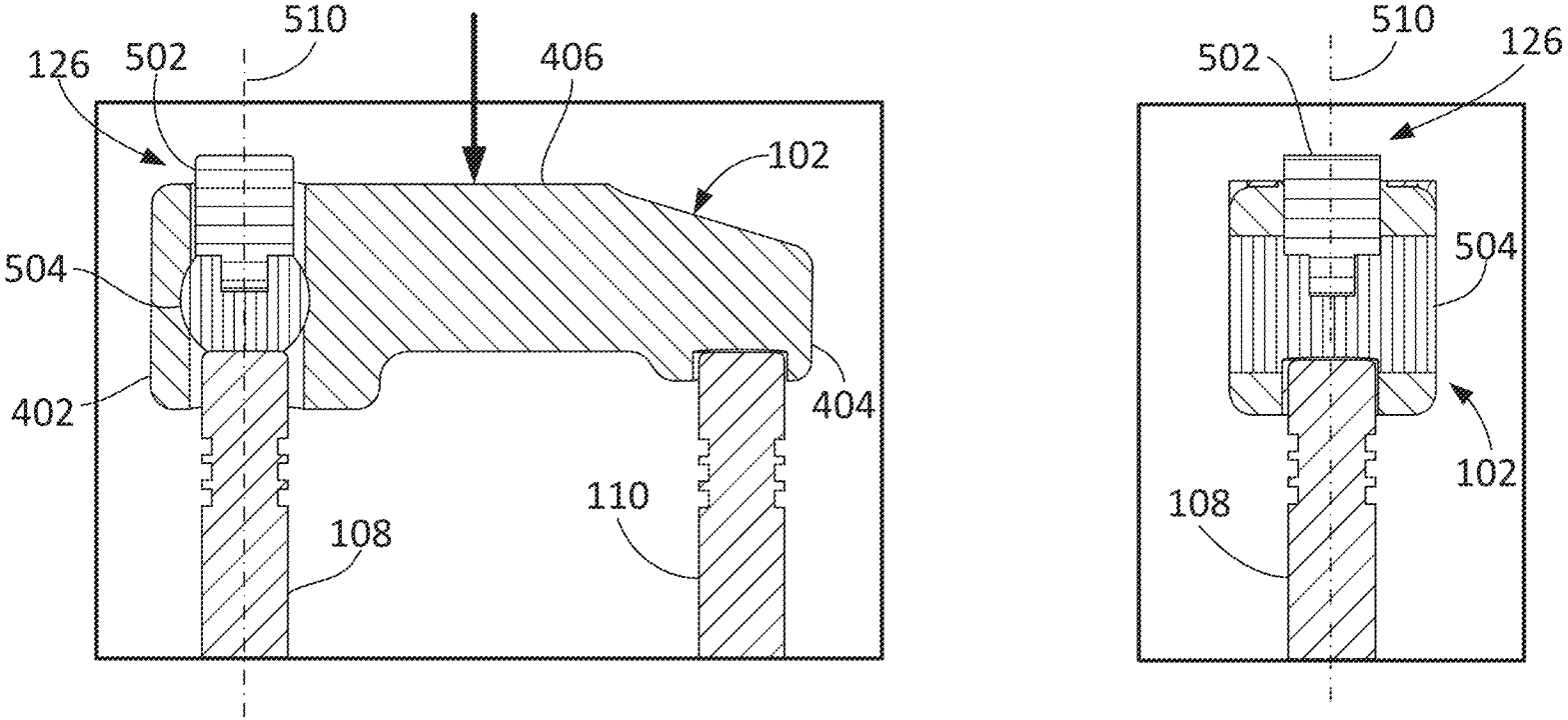
FIG. 8 illustrates the swing bridge in drive mode.
Figure 9:
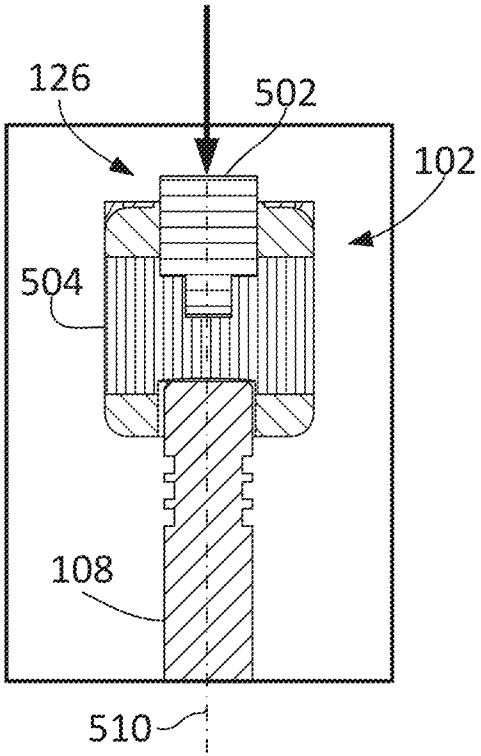
FIG. 9 illustrates the swing bridge in auxiliary mode.
Figure 9:
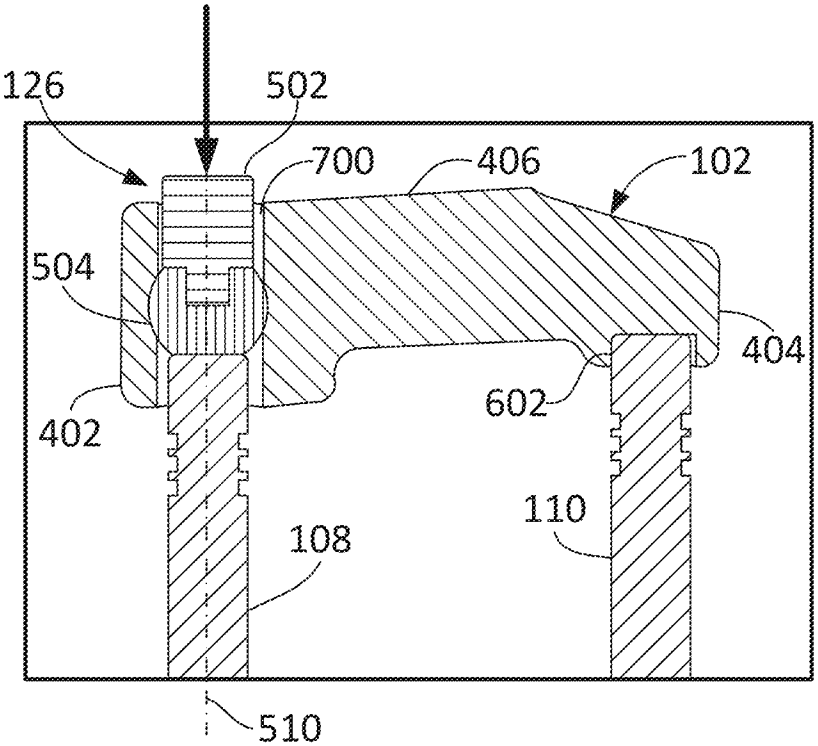

Operation of the swing bridge 102 in accordance with this disclosure will be explained with reference to FIGS. 8-9, in which FIG. 8 shows the swing bridge 102 in drive mode, that is, during main lift event of the main rocker arm 104, while FIG. 9 shows the swing bridge 102 in auxiliary mode such as in engine brake mode where the secondary rocker arm 106 is activated to selectively engage with the swing bridge 102 on demand.

Referring to FIG. 8, in which the cross-sectional view on the left is taken from the front of the valve bridge 102 while the cross-sectional view on the right is taken from the first valve side 402 of the valve bridge 102, in drive mode, the main rocker arm 104 may rock (e.g., responsive to the main lift profile) and act on the swing bridge 102 by pressing against the contact area 406 located at the middle of the swing bridge 102, thereby pushing the swing bridge 102 vertically downward (as indicated by an arrow in the figure) so as to drive open both of the engine valves 108 and 110 simultaneously. For example, the engine valves 108 and 110 may be moved in synchronization with each other to the same valve position. Moreover, during the process, horizontal axis of the swing bridge 102 may maintain substantially perpendicular to the axes of both of the engine valves 108 and 110.

In addition, when in drive mode, the secondary rocker arm 106 may be on base circle or deactivated. Alternatively or additionally, the hydraulic capsule 128 may be retracted in order to refrain from contacting the swing bridge 102 even if the secondary rocker arm 106 rotates such that the swing bridge 102, specifically the swing mechanism 126, receives zero actuation motion from the secondary rocker arm 106.

Referring to FIG. 9, in which the cross-sectional view on the left is taken from the front of the valve bridge 102 while the cross-sectional view on the right is taken from the first valve side 402 of the valve bridge 102, in auxiliary mode, the main rocker arm 104 may be on base circle or deactivated, while the secondary rocker arm 106 may rotate according to the lift profile of the secondary lift cam 120. Furthermore, the hydraulic capsule 128 is controlled to extend such that the plunger 314 may act through the swing mechanism 126 (as indicated by an arrow in the figure) in order to move the engine valve 108 independently from the engine valve 110. That is, the engine valve 110 remains unactuated regardless of movement of the second rocker arm 104. During this auxiliary valve lift event, the major axis 510 of the swing pin 502 may stay parallel to or in line with the axis of the engine valve 108 by virtue of relative rotation of the rotary cylinder 504 inside the bore 508. At the same time, the swing bridge 102 may be tilted—for example, slightly pivot a certain angular degree downward around the second valve side 404—despite the parallel position of the swing pin 502 and the valve axis of the engine valve 108. As already explained, the clearance 700 may be provided to allow for the movement of the swing bridge 102 relative to the swing pin 502. Optionally, in particular embodiments, the valve seat 602 may be further dimensioned deep enough to accommodate such swinging or tilting of the swing bridge 102, thereby ensuring proper contact with the engine valve 110 throughout the entire operation.

Figure 10:
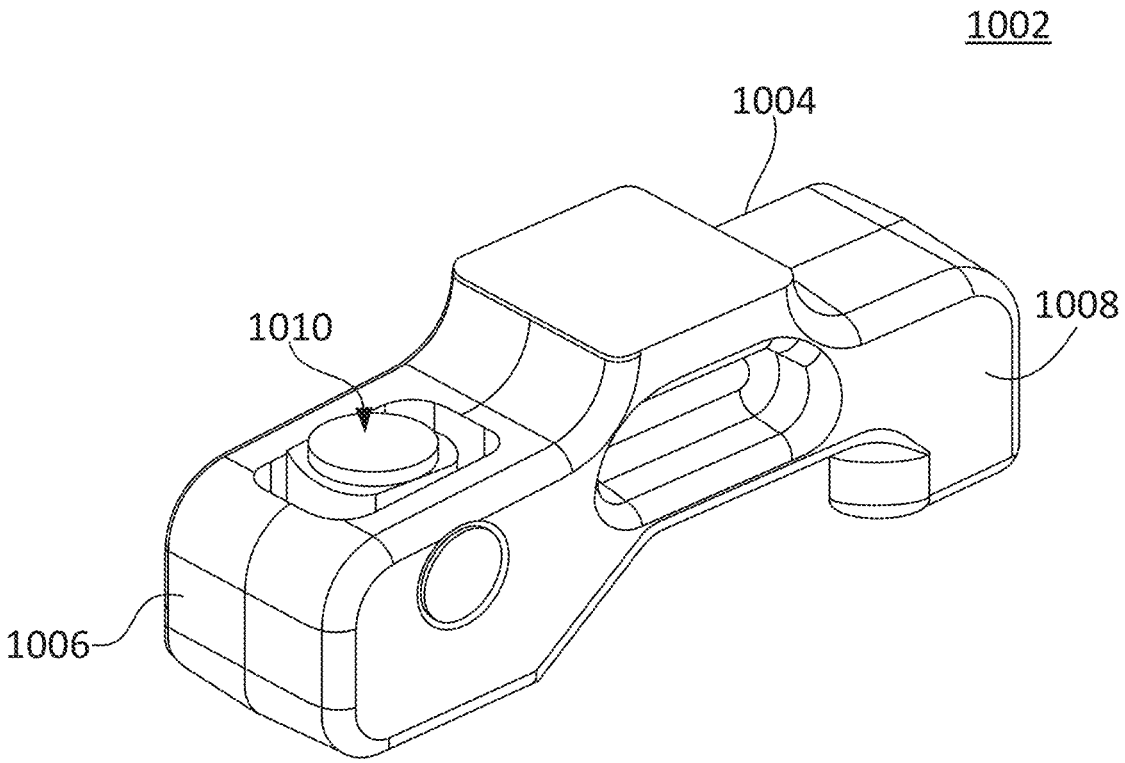
FIG. 10 illustrates another embodiment of the swing bridge according to this disclosure.
Figure 11:
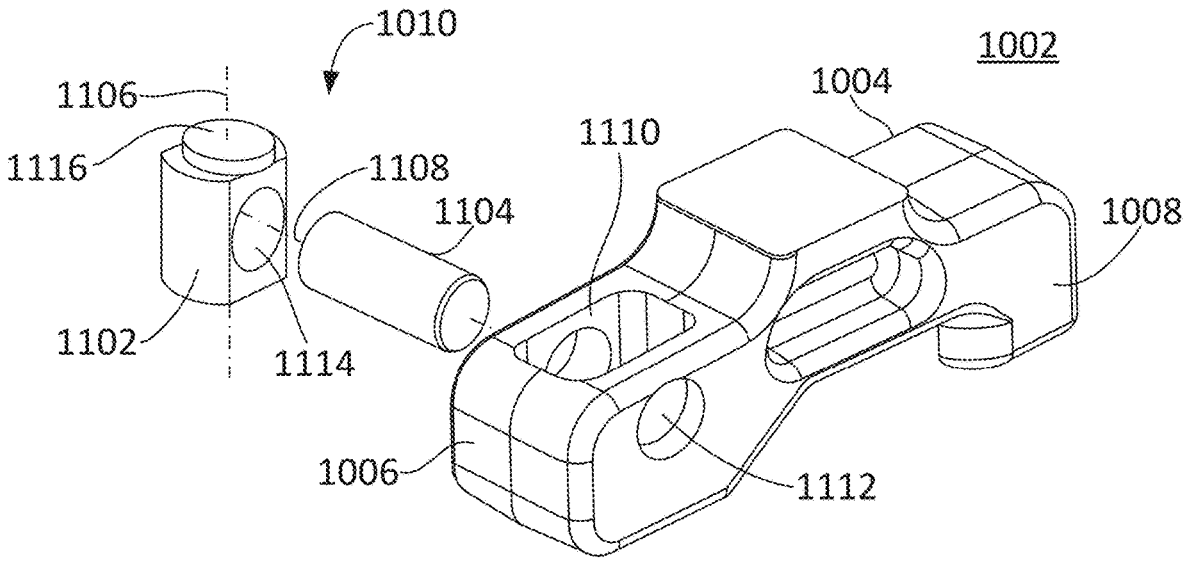
FIG. 11 illustrates an exploded view of the swing bridge of FIG. 10.
Figure 12:
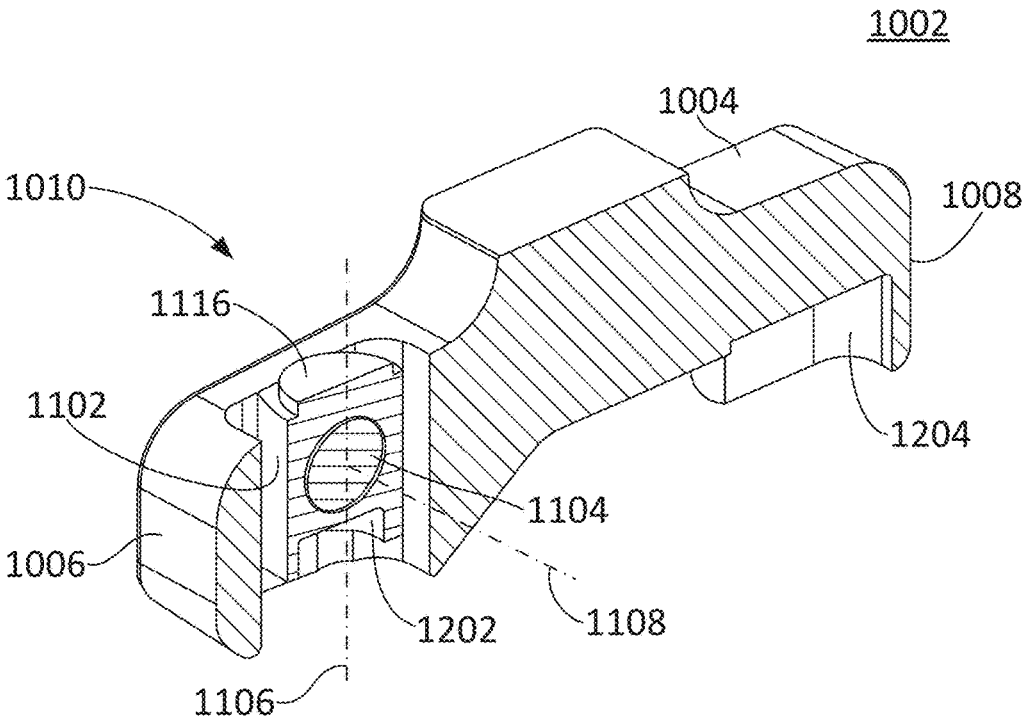
FIG. 12 illustrates a cross-sectional view of the swing bridge of FIG. 10.

FIGS. 10-12 show another configuration of a swing bridge 1002 according to this disclosure, which is similarly structured as the swing bridge 102 described above in that it includes a main body 1004 having a first valve side 1006 associated with the engine valve 108, a second valve side 1008 opposite from the first valve side 1006 and associated with the engine valve 110, and a swing mechanism 1010 located at the first valve side 1006. In particular embodiments, the swing mechanism 1010 may have a swing pin 1102 and a rotary cylinder 1104 that supports the swing pin 1102 (e.g., vertically upwards as shown in the figures). As an example and not by way of limitation, in the embodiment as shown, a major axis 1106 of the swing pin 1102 may be arranged perpendicular to a major axis 1108 of the rotary cylinder 1104. In order to accommodate the swing pin 1102 and rotary cylinder 1104, respectively, the first valve side 1006 may correspondingly be structured with a through opening 1110 which, for example, may extend along the vertical direction inside the main body 1004 and a bore 1112 that may horizontally intersect the through opening 1110.

In this embodiment as shown, the swing pin 1102 may be elongated and include a through hole 1114 that extends perpendicular to the major axis 1106 and is configured to receive the rotary cylinder 1104 in a rotatable manner. In this configuration, during assembly, the swing pin 1102 may first be inserted into the through opening 1110 to a position where the through hole 1114 is aligned with the bore 1112. Thereafter, the rotary cylinder 1104 may be fitted into the bore 1112 and through the through hole 1114 in order to support the swing pin 1102 relative to the main body 1004.

In addition, as further illustrated, the swing pin 1102 may also include at upper end thereof a contact surface 1116 for contacting the hydraulic capsule 128 so as to receive actuation motion. As an example and not by way of limitation, the contact surface 1116 may be formed as a platform that extends upwards from the upper end of the swing pin 1102. Alternatively, other possible surface structures may be provided for transmitting motion as needed. In the embodiment as shown, the swing pin 1102 additionally includes a valve seat 1202 disposed at a lower end thereof. For example, the valve seat 1202 may be a circular recess or other suitable structures for engaging the terminal end of the engine valve 108 in a motion-conveying manner. Similarly, the second valve side 1008 may include a valve seat 1204 configured as an elongated pocket or cutout so as to rest on top of the terminal end of the engine valve 110 and maintain contact throughout operation. While depicted in this way, it will be appreciated that the valve seat 1202 and/or 1204 may be structured differently for coupling to the engine valves.

Figure 13:
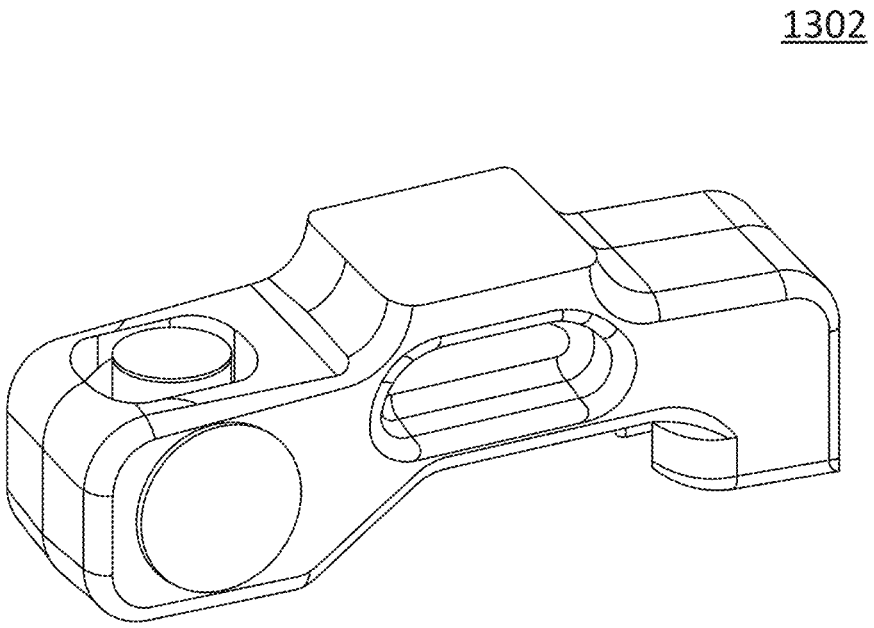
FIG. 13 illustrates yet another embodiment of the swing bridge according to this disclosure.
Figure 14:
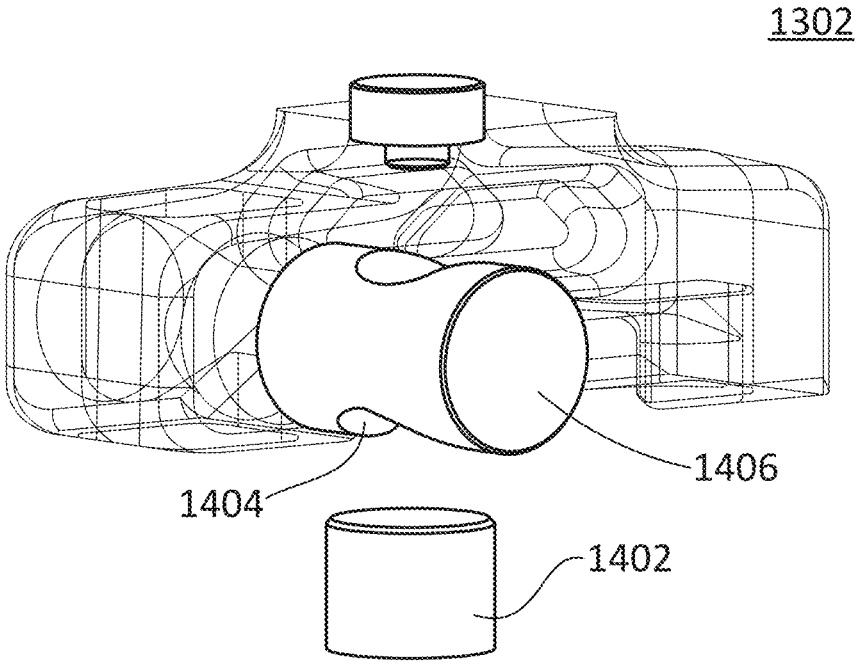
FIG. 14 illustrates an exploded view of the swing bridge of FIG. 13.
Figure 15:
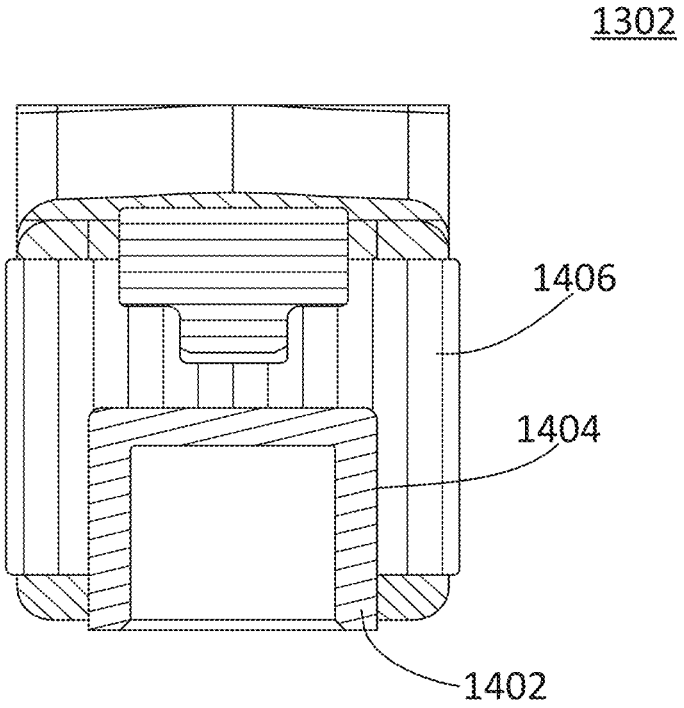
FIG. 15 illustrates a cross-sectional view of the swing bridge of FIG. 13.

FIGS. 13-15 illustrates yet another configuration of a swing bridge 1302 according to this disclosure. The swing bridge 1302 is generally similar to the swing bridge 102, except that it further comprises an optional valve cap 1402. In particular embodiments, the valve cap 1402 may be removably received by a valve seat 1404 provided at a lower surface of a rotary cylinder 1406 and is configured to cover around the terminal of the engine valve 108. In this configuration, for example, the valve seat 1404 may be dimensioned with a deeper depth so as to at least partially contain the valve cap 1402. As such, proper coupling with the engine valve 108 may be ensured while avoiding unintentional disengagement. Furthermore, it may be possible for the swing bridge 1302 to adapt to various valve sizes without the need of any significant modification.

Various embodiments of this disclosure may advantageously offer better packaging and is less demanding with regard to spatial requirement as they achieve a more compact structure. Moreover, the embodiments disclosed herein facilitate better control of motion and/or force transmission and overall system dynamics. It will also be understood that one or more other advantages may be readily apparent to one skilled in the art in view of the figures, descriptions, and claims of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A rocker arm assembly operable in a drive mode and an engine brake mode, the rocker arm assembly comprising:

a first rocker arm including a first valve end;

a second rocker arm including a second valve end;

a first valve;

a second valve;

a hydraulic capsule disposed in the first valve end, the hydraulic capsule configured to be selectively switched between on and off; and a swing bridge spanning the first and second valves, the swing bridge configured to be selectively actuated via either the first rocker arm or the second rocker arm, the swing bridge comprising:

a bridge body; and a swing mechanism disposed at least partially in the bridge body, the swing mechanism comprising a first surface configured to receive motion from the first rocker arm, the swing mechanism configured to transfer the motion to the first valve through a rotary portion configured to rotate relative to the bridge body;

wherein in the drive mode, the hydraulic capsule is switched off, and the second rocker arm engages the swing bridge during downward movement of the second valve end so as to simultaneously actuate the first and second valves, and wherein in the engine brake mode, the hydraulic capsule is switched on and engages the swing bridge via the swing mechanism during downward movement of the first valve end such that the swing bridge swings angularly so as to actuate the first valve without actuating the second valve.

2. The rocker arm assembly of claim 1, wherein when the hydraulic capsule is switched off, the hydraulic capsule does not contact the swing mechanism during rotation of the first rocker arm, and wherein when the hydraulic capsule is switched on, at least a portion of the hydraulic capsule extends outwards from the first valve end so as to engage the swing mechanism during rotation of the first rocker arm.

3. The rocker arm assembly of claim 1, wherein when the hydraulic capsule is switched on, the hydraulic capsule engages the first surface of the swing mechanism during downward movement of the first valve end, and wherein the second valve end engages a second surface of the bridge body during downward movement of the second valve end.

4. The rocker arm assembly of claim 1, wherein the bridge body comprises a first through opening, and wherein the swing mechanism comprises a swing portion disposed at least partially in the first through opening of the bridge body.

5. The rocker arm assembly of claim 4, wherein the first surface of the swing mechanism is part of the swing portion.

6. The rocker arm assembly of claim 4, wherein the bridge body comprises a second through opening intersecting the first through opening, the second through opening defining a curved surface configured to engage an outer surface of the rotary portion.

7. The rocker arm assembly of claim 6, wherein the rotary portion is disposed at least partially in the second through opening of the bridge body.

8. The rocker arm assembly of claim 6, wherein the second through opening and the first through opening intersect a bore, and wherein the bore is configured to receive the rotary portion.

9. The rocker arm assembly of claim 6, wherein the first through opening is arranged along a first direction, and wherein the second through opening is arranged along a second direction perpendicular to the first direction.

10. The rocker arm assembly of claim 4, wherein a first axis of the rotary portion of the swing mechanism is perpendicular to a second axis of the swing portion of the swing mechanism.

11. The rocker arm assembly of claim 4, wherein the rotary portion of the swing mechanism is secured axially by the swing portion of the swing mechanism.

12. The rocker arm assembly of claim 4, wherein a clearance is defined between the swing portion of the swing mechanism and the first through opening so as to allow the swing portion to swing inside the first through opening.

13. The rocker arm assembly of claim 1, wherein the swing mechanism is located at an end of the bridge body such that the swing mechanism and the end of the bridge body move together when the motion is transferred to the first valve.

14. A rocker arm assembly operable in a drive mode and an engine brake mode, the rocker arm assembly comprising:

a first rocker arm including a first valve end;

a second rocker arm including a second valve end;

a first valve;

a second valve;

a hydraulic capsule disposed in the first valve end, the hydraulic capsule configured to be selectively switched between on and off; and a swing bridge spanning the first and second valves, the swing bridge configured to be selectively actuated via either the first rocker arm or the second rocker arm, the swing bridge comprising:

a bridge body; and a swing mechanism configured to connect the first rocker arm to the first valve so as to transfer motion from the first rocker arm to the first valve, the swing mechanism comprising a rotary portion configured to interface with the first rocker arm and rotate relative to the bridge body;

wherein in the drive mode, the hydraulic capsule is switched off, and the second rocker arm engages the swing bridge during downward movement of the second valve end so as to simultaneously actuate the first and second valves, wherein in the engine brake mode, the hydraulic capsule is switched on and engages the swing bridge via the swing mechanism during downward movement of the first valve end such that the swing bridge swings angularly so as to actuate the first valve without actuating the second valve.

15. The rocker arm assembly of claim 14, wherein the bridge body comprises a first through opening, and wherein the swing mechanism further comprises a swing portion disposed at least partially in the first through opening of the bridge body.

16. The rocker arm assembly of claim 15, wherein the bridge body comprises a second through opening intersecting the first through opening, the second through opening configured to engage an outer surface of the rotary portion.

17. The rocker arm assembly of claim 16, wherein the rotary portion is disposed at least partially in the second through opening secured axially via an insert of the swing portion.

18. A rocker arm assembly operable in a drive mode and an engine brake mode, the rocker arm assembly comprising:

a first rocker arm including a first valve end;

a second rocker arm including a second valve end;

a first valve;

a second valve;

a hydraulic capsule disposed in the first valve end, the hydraulic capsule configured to be selectively switched between on and off; and a swing bridge spanning the first and second valves, the swing bridge configured to be selectively actuated via either the first rocker arm or the second rocker arm, the swing bridge comprising:

a bridge body; and a swing mechanism configured to interface with the first rocker arm so as to receive motion from the first rocker arm, and to transfer the motion to the first valve through a rotary portion configured to rotate relative to the bridge body;

wherein in the drive mode, the hydraulic capsule is switched off, and the second rocker arm engages the swing bridge during downward movement of the second valve end so as to simultaneously actuate the first and second valves, and wherein in the engine brake mode, the hydraulic capsule is switched on and engages the swing bridge via the swing mechanism during downward movement of the first valve end such that the swing bridge swings angularly so as to actuate the first valve without actuating the second valve.

19. The rocker arm assembly of claim 18, wherein the bridge body comprises a first through opening and a second through opening intersecting the first through opening, and wherein the swing mechanism comprises a swing portion disposed in the first through opening.

20. The rocker arm assembly of claim 19, wherein the rotary portion of the swing mechanism is disposed at least partially in the second through opening of the bridge body, the rotary portion configured to pass through a hole in the swing portion.

* * * * *